United States Patent [19]

Terauchi

[11] 4,221,545

[45] Sep. 9, 1980

[54] SUPPORT MECHANISM OF A WOBBLE PLATE IN A COMPRESSOR UNIT

[75] Inventor: Kiyoshi Terauchi, Isesaki, Japan

[73] Assignee: Sankyo Electric Company Limited, Isesaki, Japan

[21] Appl. No.: 948,914

[22] Filed: Oct. 5, 1978

[30] Foreign Application Priority Data

| | | | |
|---|---|---|---|
| Oct. 8, 1977 | [JP] | Japan | 52/121291 |
| Feb. 10, 1978 | [JP] | Japan | 53/14604 |
| Feb. 10, 1978 | [JP] | Japan | 53/14605 |

[51] Int. Cl.[3] ..... F04B 1/14

[52] U.S. Cl. ..... 417/269; 74/60

[58] Field of Search ..... 417/269, 270; 74/60

[56] References Cited

U.S. PATENT DOCUMENTS

| | | | |
|---|---|---|---|
| 2,917,931 | 12/1959 | Sherman | 74/60 |
| 3,018,737 | 1/1962 | Cook et al. | 74/60 |
| 3,761,202 | 9/1973 | Mitchell | 417/269 |
| 4,042,309 | 8/1977 | Hiraga | 417/269 |

*Primary Examiner*—William L. Freeh

*Attorney, Agent, or Firm*—Hopgood, Calimafde, Kalil, Blaustein & Lieberman

[57] ABSTRACT

A noiseless supporting mechanism of a wobble plate in a compressor unit of the wobble plate type comprises a support member having a spherical convex surface at its end. The support member is elastically supported on the cylinder block and is disposed in a hollow portion of the wobble plate with the spherical convex surface being in contact with a spherical concave bottom surface of the hollow portion, to support the wobble plate. A plurality of equiangularly-spaced projections are supported around the central axis of the supporting member and are disposed in corresponding recesses formed in an inner surface at an opening edge of the hollow portion to prevent the wobble plate from rotating. The wobble plate thus nutates along the spherical convex surface by the rotation of the associated cam rotor.

4 Claims, 10 Drawing Figures

SUPPORT MECHANISM OF A WOBBLE PLATE IN A COMPRESSOR UNIT

BACKGROUND OF THE INVENTION

This invention relates generally to compressor units of the wobble plate type, and, in particular, to a support mechanism of the wobble plate in such compressor units. In a known compressor unit, the rotation of the drive shaft is converted into reciprocating motion through a cam rotor having a sloping end surface mounted on an end of the drive shaft and a wobble plate disposed on the sloping surface through a needle bearing therebetween. The wobble plate is supported on a fixed member such as a cylinder block in such a manner that the wobble plate is prevented from rotating but is nutatable or able to wobble. Thus, the wobble plate wobbles by the rotation of the cam rotor, and the piston rods connected to the wobble plate are reciprocated to compress fluid within cylinders.

This compressor unit has been known to be generally suitable for, and has been commercially used for, refrigerant compressors in cooling systems for automobiles.

In a known supporting mechanism of the wobble plate, a bevel gear is fixed to the wobble plate at the center thereof and another bevel gear engaging the bevel gear of the wobble plate is supported on the cylinder block in such a manner that the rotation of the another bevel gear is prevented. Both of the bevel gears are provided with a ball seat at their centers, and a bearing ball is seated in the ball seats. Thus, the wobble plate is prevented from rotating by the engagement between both bevel gears and is able to nutate along the ball surface.

A deficiency in this mechanism is that considerable noise is produced by the engagement between the both bevel gears in the operation of the compressor.

In another known mechanism, the wobble plate is supported by a bearing ball similar to the above described mechanism but the rotation of the wobble plate is prevented by a pin fixed to the lower end of the wobble plate. The pin is slidably fitted in an axial groove formed in an inner wall of the compressor housing.

In this arrangement, the pin reciprocates along the groove with a considerable sliding friction between the pin and the groove wall thereby introducing a power loss. Furthermore, the pin is subjected to an undesired force so that the reliability of the pin and the compressor unit as a whole is thus degraded, and the compressor housing is required to be large because the groove must be formed therein.

Yet another known wobble plate supporting mechanism comprises a universal hook joint connected to and end of the wobble plate, with the other end of the wobble plate being fixed to the cylinder block. In this arrangement, the hook joint is subjected to an undesired considerable radial load, so that the reliability of the mechanism is degraded.

SUMMARY OF THE INVENTION

Accordingly, an object of this invention is to provide an improved supporting mechanism of the wobble plate in a compressor of the wobble plate type.

Another object of this invention is to provide a noiseless compressor unit having greater endurance than any of the conventional compressor units.

Still another object of this invention is to provide a compressor unit of the wobble plate type wherein the above objects are realized with a simple construction.

According to an aspect of this invention, the wobble plate is provided with a hollow portion at the center thereof. The bottom surface of the hollow portion is spherical concave surface, and a plurality of equangularly spaced recesses are formed in the inner surface of the hollow portion at the opening edge thereof. A supporting member supported on the cylinder block is disposed in the hollow portion of the wobble plate. The supporting member is formed of a spherical convex surface at the end thereof which is in close contact with the spherical concave bottom surface of the hollow portion. The supporting member is also provided with a plurality of equiangularly spaced projections at the peripheral surface thereof. There projections are fitted into the corresponding respective recesses of the wobble plate. The supporting member is supported on the cylinder block in such a manner that it is prevented from rotating and is elastically urged toward the wobble plate.

In another aspect of this invention, the projections on the supporting member comprises bearing balls which are partially fitted in grooves axially formed on the peripheral surface of the supporting member at equiangularly spaced positions. The recesses of the wobble plate are also axial grooves.

In still another aspect of this invention, the supporting member comprises a bearing ball having four pins which radially project at equiangularly spaced positions on the equator of the ball. The ball is seated in a seat formed on an end of a rod which is supported on the cylinder block in such a manner that the rod is prevented from rotating and is elastically urged toward the wobble plate. A pair of pins on a diameter of the ball are fitted into two recesses which are radially formed on the end of the rod at opposite sides of the seat so that the bearing ball is supported on the end of the rod without the rotation of the ball about the center axis of the rod. The other pair of pins are fitted in the corresponding recesses of the wobble plate. Thus, the wobble plate is prevented from rotating but is nutatable along the spherical surface of the bearing ball.

Further objects, features and other aspects of the invention will be easily understood from the following detailed description in connection with preferred embodiments of this invention referring to annexed drawings.

DETAILED DESCRIPTION OF PREFERRED EMBODIMENTS

Figure 1:
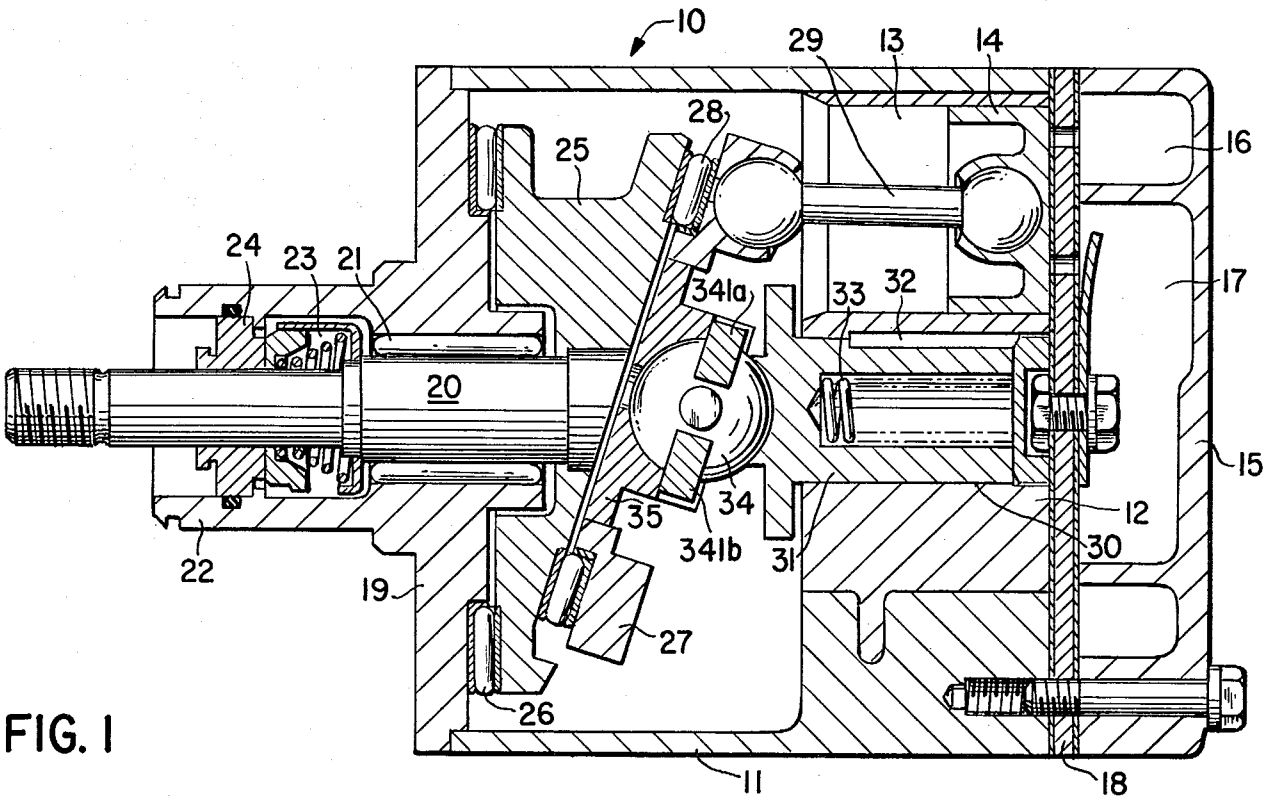
FIG. 1 is a cross sectional view of a compressor unit according to one embodiment of this invention.

Referring to FIG. 1, a compressor unit generally designated 10, comprises a compressor housing 11 having a cylinder block 12 fixed therein at a rear end thereof. The cylinder block 12 is provided with a plurality of equiangularly spaced cylinder bores 13 axially formed in parallel with one another. A corresponding plurality of pistons 14 (one of which is seen in FIG. 1) are respectively slidably fitted within each of the cylinder bores to compress fluid therein by reciprocating motion thereof.

On the rear end of cylinder block, a cylinder head 15 having a suction chamber 16 and a discharge chamber 17 is mounted by bolts together within a valve member, which includes a valve plate. Valve plate 18 controls the flow of fluid between each of the cylinder bores and the suction chamber and between each cylinder and the discharge chamber.

A front end plate 19 is mounted on a front end of the compressor housing 11. End plate 19 bears a drive shaft 20 extending through a central opening thereof by a radial needle bearing 21. The front end plate 19 has a sleeve 22 projecting therefrom, which surrounds the drive shaft 20 to define a shaft seal cavity 23 around the drive shaft. A shaft seal assembly 24 is mounted on the drive shaft 20 in the shaft seal cavity.

A cam rotor 25 is fixed by mounted on an inner end of the drive shaft 20, to be rotated together with the drive shaft, and a thrust needle bearing 26 is disposed between the inner surface of the front plate 19 and an end surface of the cam rotor 25. An opposite end of the cam rotor 25 is a sloping surface inclining to the drive shaft center axis, on which a wobble plate 27 is disposed through a thrust needle bearing 28. The wobble plate is connected to piston rods 29, which are respectively connected to pistons 14.

In operation, the drive shaft 20 is driven by any external driving source such as an engine of a car through, for example, a pulley and a belt, to rotate the cam rotor 25. The wobble plate 27 is caused to nutate or wobble by the rotation of the cam rotor 25, thereby to impart reciprocating motion to the piston rods and pistons so that fluid or refrigerant gas is compressed within respective cylinder bores 13.

In order to ensure the desired wobbling motion of the wobble plate 27, the wobble plate must be nutatably supported at a wobbling center and must be prevented from rotating.

In the embodiment of the invention of FIGS. 1–3, the cylinder block 12 is provided with a center bore 30, in which a rod 31 is axially slidably fitted. The rod 31 is prevented from rotating by means of a key 32, and is urged toward the wobble plate 27 by a coil spring 33 disposed in the center bore. The rod 31 is provided with a hole at its rear end in which the spring 33 is inserted. The other end of the spring 33 is in contact with a back wall of, or a stopper in, the center bore 30.

Figure 2A:
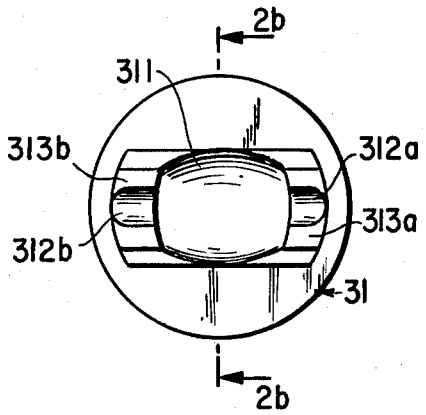
FIGS. 2*a* and 2*b* are respectively a front view and a sectional view taken along line 2B—2B in FIG. 2*a*, of a rod member used in the compressor unit in FIG. 1.
Figure 2B:
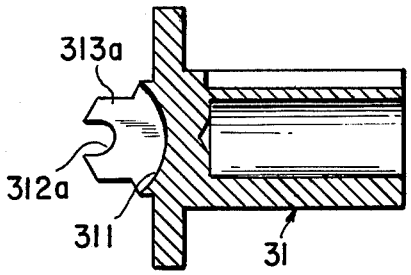

Referring to FIGS. 2*a* and 2*b*, the rod 31 is provided with a ball seat 311 of a spherical concave surface at the front end thereof, and with two recesses 312*a* and 312*b* at opposite sides of the seat 311. The recesses are formed in end surfaces of projections 313*a* and 313*b* which project forwardly from opposite portion of the circumference of the ball seat 311.

Referring to FIG. 1, a bearing ball 34 is seated on the ball seat 311 of the rod 31. The bearing ball 34 has four pins 341 which radially project from the surface thereof at angularly equally spaced positons on the equator of the ball. Only two pins are shown in FIG. 1 by 341*a* and 341*b*, which are on a diameter of the ball 34. The other two pins which are on another diameter of the ball and are not in shown in FIG. 1 are fitted into the recesses 312*a* and 312*b* of the rod 31. Thus, the bearing ball 34 is supported on the forward end of the rod 31 and is prevented from rotating about the axis of the rod 31.

A ball seat member 35 is fixed to a central portion of the wobble plate 27 for receiving the bearing ball 34.

Figure 3A:
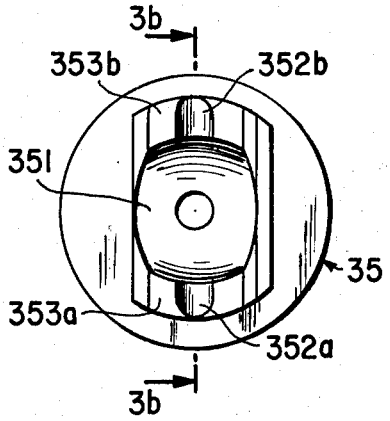
FIGS. 3*a* and 3*b* are a front view and a sectional view taken along line 3B—3B in FIG. 3*a*, of a ball seat member used in the compressor unit shown in FIG. 1.
Figure 3B:
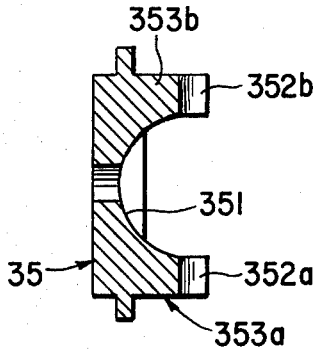

Referring to FIGS. 3*a* and 3*b*, the ball seat member 35 is provided with a ball seat 351 of a spherical concave surface and with two recesses 352*a* and 352*b* at opposite portions of the circumference of the ball seat. The recesses 352*a* and 352*b* are formed on ends cf projections 353*a* and 353*b* projecting from opposite portions of the circumference of the ball seat 351.

The bearing ball 34 is also seated on the ball seat 351 of the ball seat member 35 and the pins 341*a* and 341*b* are fitted into the recesses 352*a* and 352*b* of the ball seat member 35. Accordingly, the ball 34 is prevented from rotating about the central axis of the wobble plate.

The wobble plate 27 is thus supported by the bearing ball 34, which is supported on the rod 31, and is urged to the sloping surface of the cam rotor 25 by the axial force given to the rod 31 by the coil spring 33. Furthermore, rotation of the wobble plate 27 about its central axis is prevented by means of pins 341 engaged into the recesses 352. But the rotation of the wobble plate 27 about pins 341*a*–*341b* is possible and the rotation of the wobble plate 27 together with the bearing ball 34 about the other pins, which are not shown in FIG. 1 is also possible, so that the desired wobbling motion of the wobble plate 27 is enabled.

In the embodiment of FIGS. 1–3, the radial and thrust load does not act on pins 341 but is borne by the ball 34 and only a relatively small torque acts on pins 341. Therefore, the wobble plate supporting mechanism is superior to known mechanism in the endurance. Furthermore, since there is only a sliding friction between reliability and bearing ball 34 and seats 311 and 351, and since there is no other sliding friction, such as is encountered in the compressor disclosed in U.S. Pat. No. 3,761,202 or engaging motion such as gears, as in the compressor disclosed in U.S. Pat. No. 3,552,886 the power loss and noise are reduced in this mechanism.

Figure 4:
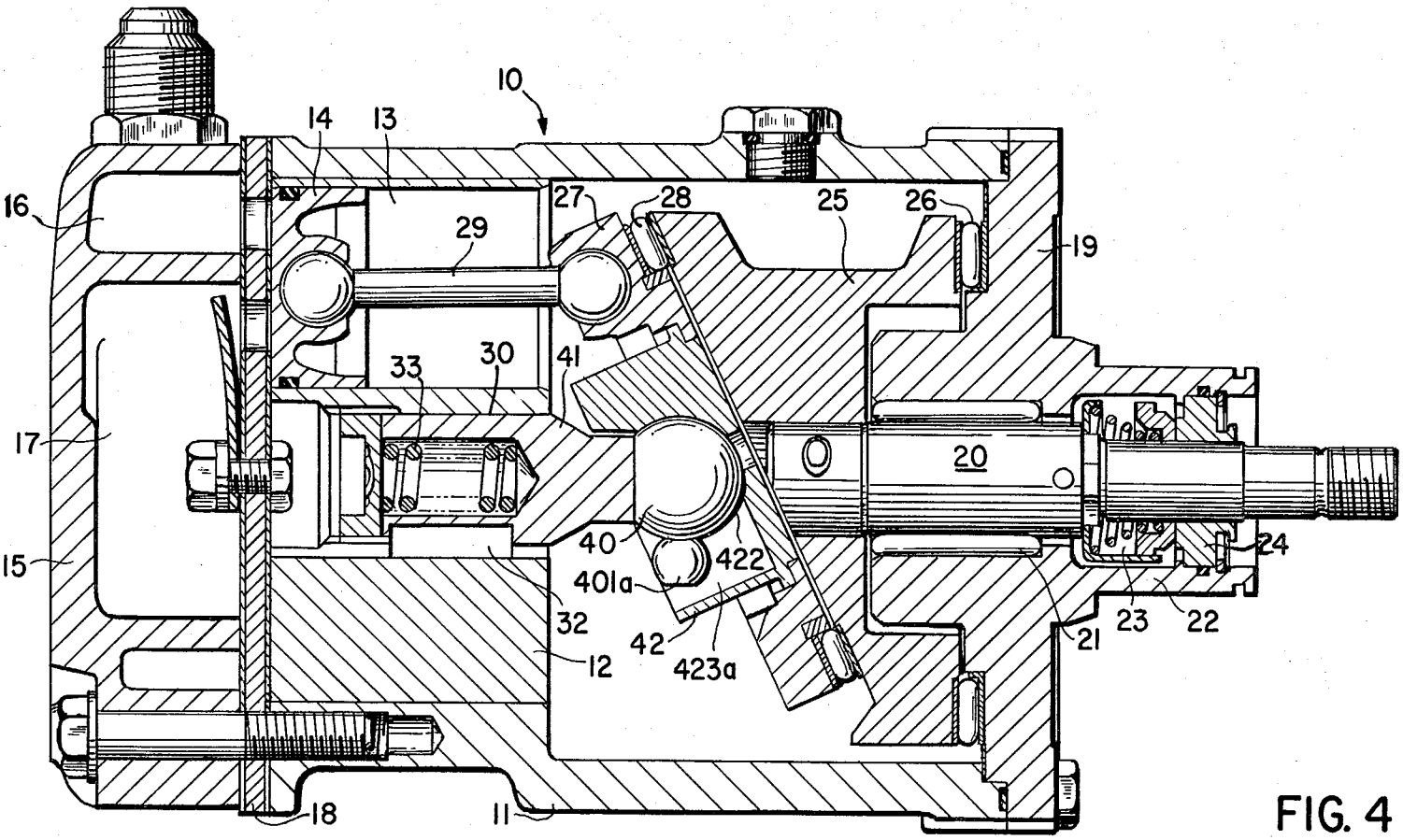
FIG. 4 is a cross sectional view of a compressor unit according to another embodiment of this invention.
Figure 5:
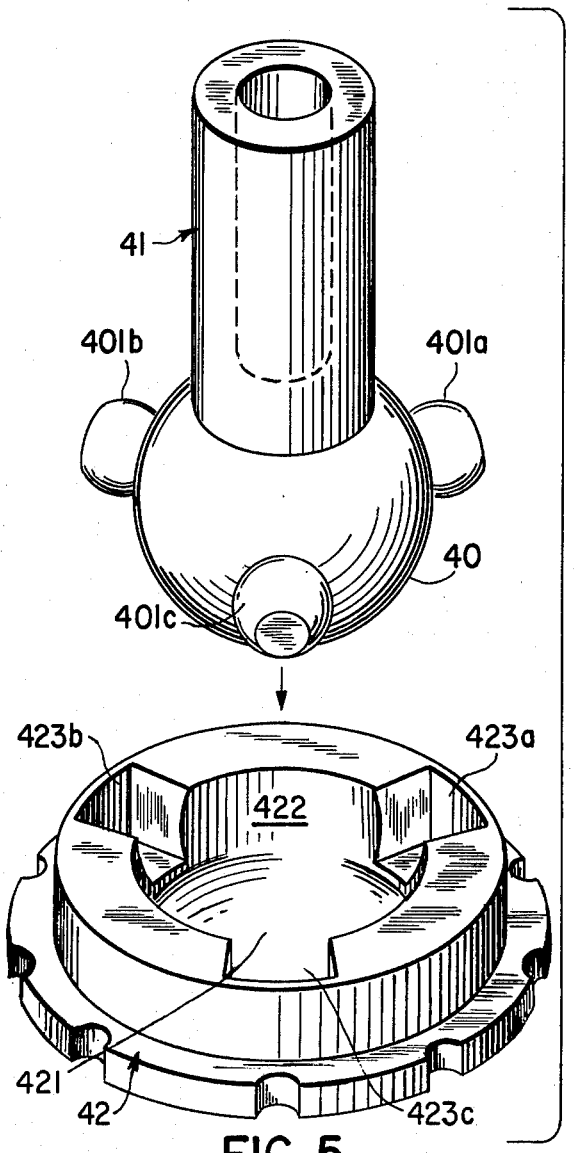
FIG. 5 is a perspective view of a rod member and a ball seat member used in the compressor unit shown in FIG. 4.
Figure 6:
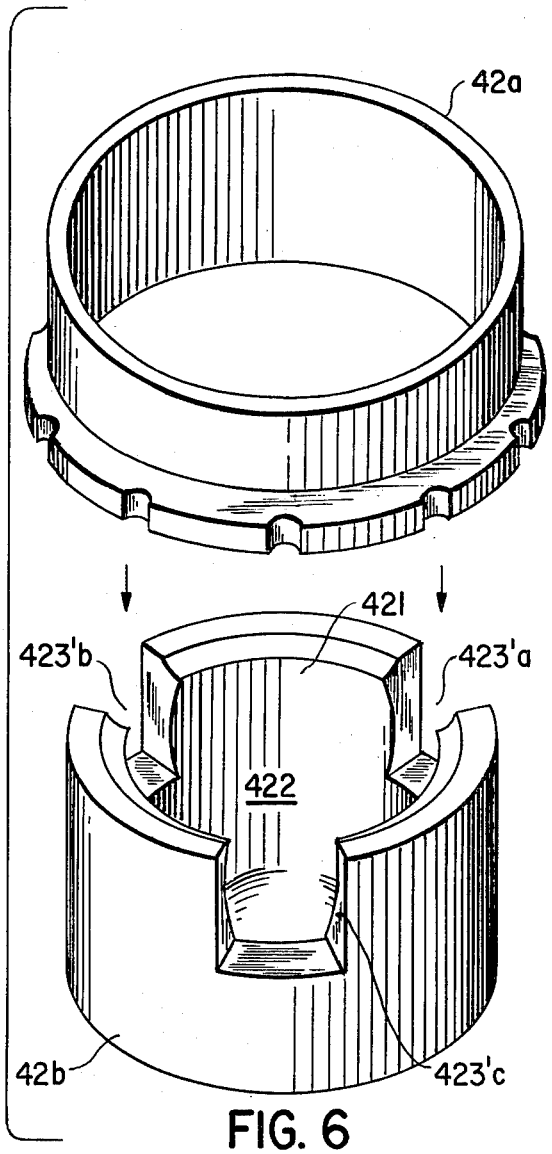
FIG. 6 is a perspective view of parts of another example of the ball seat member in FIGS. 4 and 5.

The embodiment of the invention of FIGS. 4–6 is similar the embodiment of FIG. 1 except for the supporting mechanism of the wobble plate. Therefore, similar parts in FIG. 4 are represented by the same reference numerals as in FIG. 1 and the description of these similar parts is omitted for purposes of simplification.

In the embodiment of FIG. 4, the wobble plate 27 is supported by a ball portion 40 formed at the forward end of a rod 41, which is fitted into the center bore 30 of the cylinder block 12, similarly as the rod 31 in the embodiment of FIG. 1.

A seat member 42 for receiving the ball portion 40 of the rod 41 is fixedly mounted at the central portion of the wobble plate 27.

As shown in FIG. 5, three radial projections 401*a*, 401*b* and 401*c* are formed on the ball portion 40 at equiangularly spaced positions about the central axis of the rod 41. The seat member 42 has a hollow portion 421, the bottom of which is a spherical concave surface 422 to mate with the spherical surface of the ball portion 40. Three recesses 423*a*, 423*b* and 423*c* are formed in the inner wall of the hollow portion 421 at an opening edge of hollow portion 421, for receiving projections 401*a*, 401*b* and 401*c*, respectively.

The seat member 42 may, as shownin FIG. 5, be formed of a single body, but it may also be formed of two parts as shown in FIG. 6, which shows a ring member 42*a* fixedly mounted on a hollow body 42*b* having the hollow portion 421 and cut-away portions 423'*a*, 423'*b* and 423'*c* to form the seat member 42.

Referring to FIG. 5, the forward end of the ball portion 40 is caused to be in close contact with the spherical concave surface 422 of the ball seat by the axial force acting to the rod 41 by the coil spring 33. Projections 401*a*, 401*b* and 401*c* are respectively disposed in recesses 423*a*, 423*b* and 423*c*.

Thus, the wobble plate 27 nutates along the spherical convex surface of the ball portion 40 and is prevented from rotating by the projections 401*a*, 401*b* and 401*c* disposed in the recesses 423*a*, 423*b*, and 423*c*.

In order to allow the nutating motion of the wobble plate 27, the recesses 423*a*–*423c* must be formed axially deep.

Figure 8:
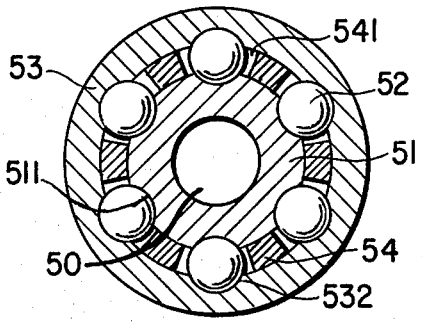
FIG. 8 is a sectional view taken along line 8—8 in FIG. 7.
Figure 7:
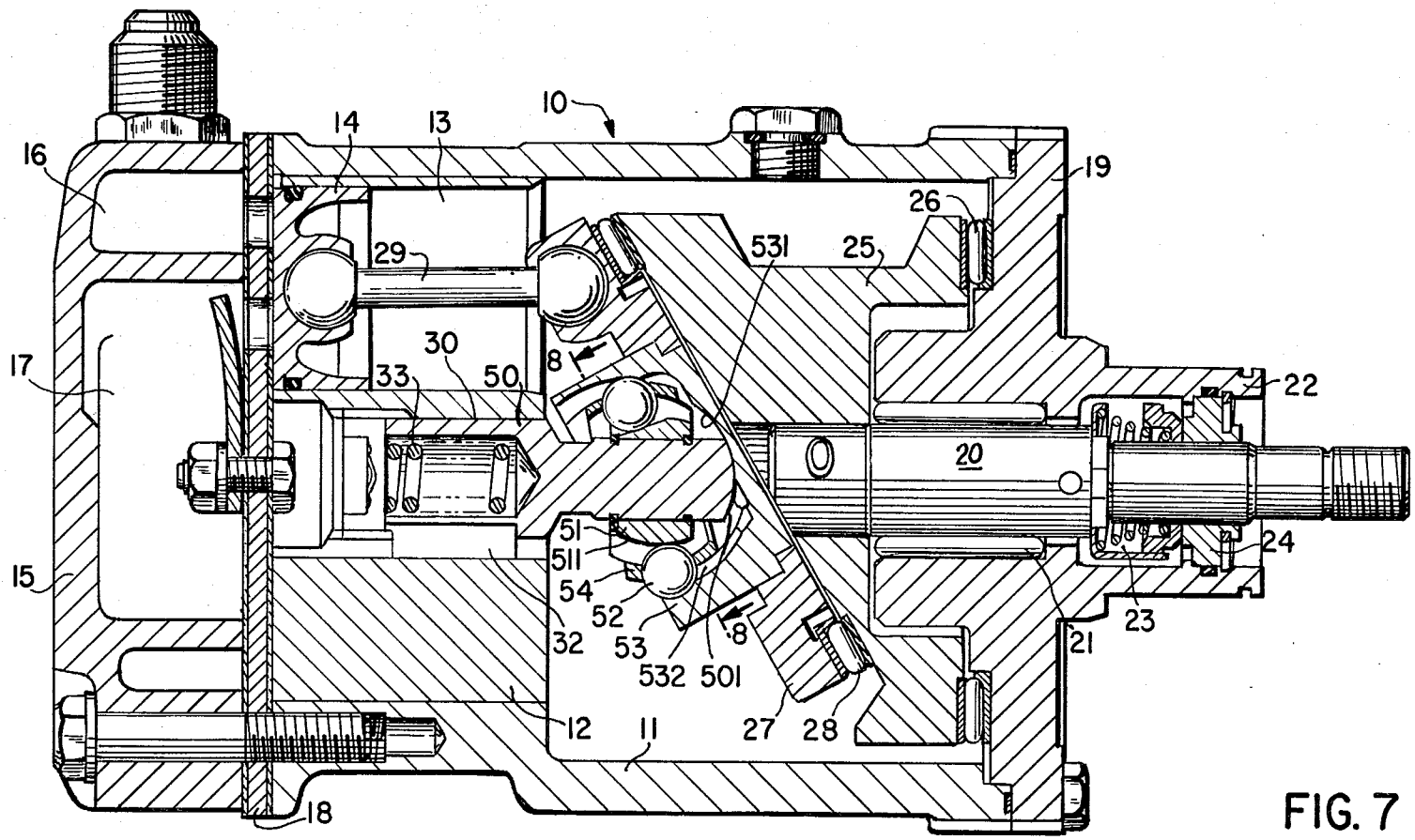
FIG. 7 is a cross-sectional view of a compressor unit according to yet another embodiment of this invention.

A further embodiment of the invention shown in FIGS. 7 and 8, is also similar to the one of FIG. 1 except for the supporting mechanism of the wobble plate. Therefore, description of similar parts of the embodiment of FIG. 7 is also omitted.

In the embodiment of FIG. 7, a rod 50 is fitted in the center bore 30 of the cylinder block 12, similar to the rod 31 in FIG. 1.

The forward end of the rod 50 is formed to define a spherical convex surface 501.

Referring to FIG. 8 together with FIG. 7, a ring member 51 is fixedly mounted on the rod 50 at a position near the forward end of the rod. The outer surface of the ring member 51 is of a spherical convex surface in which a plurality of axial grooves 511 (six grooves are shown in FIG. 8) are formed at equiangularly spaced positions. The contour of the bottom of each groove is spherical or round in the cross section, as viewed in FIG. 8 and is elliptical arc-shaped, or straight in axial section, as viewed in FIG. 7.

Bearing balls 52 are inserted in the grooves 511.

The wobble plate 27 has a hollow member 53 fixed at a central portion thereof. The bottom of the hollow portion of the hollow member 53 is formed to define a spherical concave surface 531 to engage the spherical convex surface 501 of the rod 50. The inner side surface of the hollow portion is also a spherical concave surface in which a plurality of axial grooves 532 are formed similar to the grooves 511.

The forward end portion of the rod 50 is inserted within the hollow portion of the hollow member 53 and the spherical convex end surface 501 is caused to be in close contact with the spherical concave bottom surface 531 of the hollow portion by the axial force of the coil spring 33 urging the rod 50.

The ring member 51 and bearing balls 52 are also disposed in the hollow portion with bearings 52 being received in respective recesses 532 in the inner side surface of the hollow portion.

A bearing ball retainer or cage 54 having ball pockets 541 is disposed between the ring member 51 and the inner side surface of the hollow portion.

It will be understood that rod 50, ring member 51, bearing balls 52, cage 54 and hollow member 53 form a universal joint, which allows the wobble plate 27 to nutate along the spherical convex surface 501 without rotation.

In the embodiment of FIGS. 7 and 8, the thrust load is borne at the forward end of the rod 50 and the bearing balls 52 prevent the wobble plate from rotating. The bearing balls 52 run along grooves 511 and 532 during the motion of the wobble plate 27.

In this arrangement, the wobble plate 27 is supported on the spherical convex surface 501 and bearing balls 52, such that noise, vibration and power loss is reduced.

This invention has been described in detail in connection with preferred embodiments, which are only for exemplification. It will be understood by those skilled in the art that and modifications to the described embodiments are possible without departing from the scope of this invention.

What is claimed is:

1. In a compressor unit including a cylinder block having an axial center bore and a plurality of cylinder bores axially formed therein around the center bore, a plurality of piston means including piston rods respectively slidably fitted within said cylinder bores to compress fluid within the cylinder bores by the reciprocating motion thereof, a cam rotor disposed to rotate on an extension of the center axis of said cylinder block, and a wobble plate connected to said piston rods, said wobble plate being disposed on a surface of said cam rotor and supported on said cylinder block to convert rotating motion of said cam rotor to reciprocating motion to be imparted to said piston means; the improvement which comprises: a rod member axially slidably but non-rotatably fitted in said center bore of said cylinder block and elastically urged toward said wobble plate, said wobble plate having a hollow portion at a central portion thereof in an end surface thereof facing said cylinder block, a spherical concave bottom surface of said hollow portion and a plurality of equiangularly spaced first recesses formed in the inner surface of the hollow portion at the opening edge thereof, a member for supporting said wobble plate supported on a projected end of said rod member from said center bore and disposed in said hollow portion of said wobble plate, said supporting member including a spherical convex surface at an end portion in close contact with said spherical concave bottom surface of said wobble plate, and a plurality of equiangularly spaced radial projections mounted on said supporting member about the center axis of said rod member and respectively disposed in said first recesses of said wobble plate.

2. The improvement as claimed in claim 1, wherein said supporting member is a ball portion formed at the projected end of said rod member, a said a plurality of projections being fixed onto the surface of said ball portion.

3. The improvement as claimed in claim 1, wherein said supporting member is a bearing ball having at least four pins fixed on the surface thereof which radially project at equiangularly spaced positions on the equator of said bearing ball, said ball being seated on a ball seat formed at the projected end of said rod member and being supported in the seat by fitting two opposite ones of said pins into two second recesses formed in the projected end of said rod member at opposite sides of said seat, said ball being seated on said spherical concave bottom surface of said wobble plate with the remaining ones of said pins being fitted into said recesses of said wobble plate.

4. The improvement as claimed in claim 1, wherein said supporting member comprises an end portion of said rod member having said spherical convex surface at its end, and a ring member fixedly mounted on said end portion of said rod member, said ring member having a spherical convex outer surface on which a first plurality of equiangularly spaced axial grooves are formed about the center axis of said rod member, bearing ball elements being respectively received in said first plurality of axial grooves, said first recesses in said wobble plate being in the form of a second plurality of equiangularly spaced axial grooves radially aligned with said first plurality of axial grooves and extending in the inner surface of said hollow portion and which also receive said bearing ball elements.

* * * * *